US009932973B2

(12) United States Patent
Nakanishi

(10) Patent No.: US 9,932,973 B2
(45) Date of Patent: Apr. 3, 2018

(54) RECIPROCATING PUMP WITH HIGH-PRESSURE SEAL

(71) Applicant: Maruyama Mfg. Co., Inc., Tokyo (JP)

(72) Inventor: Toshiro Nakanishi, Togane (JP)

(73) Assignee: Maruyama Mfg. Co., Inc., Tokyo (JP)

( * ) Notice: Subject to any disclaimer, the term of this patent is extended or adjusted under 35 U.S.C. 154(b) by 388 days.

(21) Appl. No.: 13/899,207

(22) Filed: May 21, 2013

(65) Prior Publication Data

US 2013/0309112 A1 Nov. 21, 2013

(30) Foreign Application Priority Data

May 21, 2012 (JP) ..... 2012-115531

(51) Int. Cl.

| | |
|---|---|
| ***F04B 1/14*** | (2006.01) |
| ***F04B 19/00*** | (2006.01) |
| ***F04B 1/04*** | (2006.01) |
| ***F04B 53/16*** | (2006.01) |

(52) U.S. Cl.

CPC ..... *F04B 19/00* (2013.01); *F04B 1/0448* (2013.01); *F04B 1/14* (2013.01); *F04B 53/162* (2013.01); *F04B 1/141* (2013.01)

(58) Field of Classification Search

CPC .. F04B 1/14; F04B 1/141; F04B 1/143; F04B 1/145; F04B 39/0276; F04B 39/0284; F04B 39/0292; F04B 27/109; F15B 15/1471

USPC ..... 417/437, 366, 369, 371, 372; 92/165 R, 92/153

See application file for complete search history.

(56) References Cited

U.S. PATENT DOCUMENTS 1,693,418 A * 11/1928 Warner ..... F04B 35/04 184/6
1,715,408 A * 6/1929 Christensen ..... F04B 39/0292 184/18

(Continued)

FOREIGN PATENT DOCUMENTS

JP H0658244 * 3/1994 ..... F04B 1/04
JP H0658244 A 3/1994

(Continued)

OTHER PUBLICATIONS

JPH0658244 translation, Takeo et al.,Fluid Pressure Pump, Mar. 1, 1994.*

(Continued)

*Primary Examiner* — Patrick Hamo
(74) *Attorney, Agent, or Firm* — Osha Liang LLP

(57) ABSTRACT

In a reciprocating pump comprising a reciprocating member adapted to reciprocate as driven by a drive unit contained in a drive unit case, so as to perform a pumping action such that a liquid in use is aspirated into a pump chamber formed axially in front of the reciprocating member and pushed out under pressure and further comprising a high-pressure seal in slidable contact with an outer peripheral surface of the reciprocating member axially behind the pump chamber so as to prevent the liquid in use from leaking out when a high pressure is generated in the pump chamber, a flow path for the liquid in use to flow so as to bathe the drive unit therewith is provided within the drive unit case, while the rear side of the high-pressure seal is in contact with the liquid in use flowing through the drive unit case.

9 Claims, 3 Drawing Sheets

(56) References Cited

U.S. PATENT DOCUMENTS 2,792,790 A * 5/1957 Capps ..... F04B 39/00 184/18
3,074,625 A * 1/1963 Paterson ..... F01M 1/12 92/153
3,204,619 A * 9/1965 Rubinowitz ..... F01N 1/04 123/195 R
3,221,564 A * 12/1965 Raymond ..... F01B 3/0002 384/125
3,407,746 A * 10/1968 Johnson ..... F04B 1/00 417/486
3,812,677 A * 5/1974 Greis ..... F02G 1/053 60/517
4,222,714 A * 9/1980 Dantlgraber ..... F04B 1/0408 417/273
4,875,690 A * 10/1989 Tojo ..... F16J 15/186 277/530
5,013,219 A * 5/1991 Hicks ..... F04B 1/14 417/269
5,085,054 A * 2/1992 Katsuda ..... F02G 1/044 60/517
5,215,443 A * 6/1993 Hani ..... F04B 1/124 417/269
5,685,703 A * 11/1997 Fukuoka ..... F04C 18/3564 418/63
6,016,786 A * 1/2000 Rodriquez-Amaya F02M 41/125 123/299
6,216,583 B1 * 4/2001 Klinger ..... F02M 59/102 123/90.35
6,641,377 B2 * 11/2003 Toyama ..... F04B 35/045 417/416
7,011,012 B2 * 3/2006 Hartsleben ..... F02M 59/06 92/153
7,011,193 B2 * 3/2006 Lemmens ..... F16F 9/3405 188/322.17
7,347,186 B2 * 3/2008 Ricco et al. ..... 123/446
7,621,382 B2 * 11/2009 Zdeb ..... F16F 9/3415 188/297
8,973,556 B2 * 3/2015 Hoefner ..... F02M 37/0047 123/446
9,145,860 B2 * 9/2015 Usui ..... F02M 59/462
2004/0025830 A1 * 2/2004 Draper ..... F02M 45/02 123/299
2005/0106049 A1 * 5/2005 Aoki ..... F02M 47/027 417/437
2006/0185628 A1 * 8/2006 Akaike ..... F01P 1/02 123/41.65
2006/0272599 A1 * 12/2006 Johnson ..... F02B 17/005 123/73 A
2007/0051327 A1 * 3/2007 Nino ..... F01M 13/04 123/73 C
2009/0097991 A1 * 4/2009 Rosu ..... F04B 1/0426 417/273
2009/0123303 A1 * 5/2009 Ohnishi ..... F04B 39/14 417/270
2009/0246045 A1 * 10/2009 Kathmann ..... F04B 5/00 417/375
2010/0084489 A1 * 4/2010 Chang ..... F02M 47/027 239/132
2011/0020157 A1 * 1/2011 Schmidt ..... 417/437
2011/0027106 A1 * 2/2011 Ochiai ..... 417/269
2011/0239856 A1 * 10/2011 Tiller ..... F04B 53/18 92/153
2012/0145113 A1 * 6/2012 Mordukhovich C10M 175/0008 123/196 A
2014/0034030 A1 * 2/2014 Jaasma ..... F01M 13/022 123/572

FOREIGN PATENT DOCUMENTS

JP 2004218459 A 8/2004
JP 2007177704 A 7/2007
JP 2011-017376 A 1/2011

OTHER PUBLICATIONS

Patent Abstract of Japan for Japanese Publication No. 2011-017376 published Jan. 27, 2011 (1 page).
Japanese Office Action in corresponding Japanese application No. 2012-115531 dated Aug. 26, 2014 (2 pages).

* cited by examiner

RECIPROCATING PUMP WITH HIGH-PRESSURE SEAL

BACKGROUND OF THE INVENTION

Field of the Invention

The present invention relates to a reciprocating pump.

Related Background Art

Conventionally known as a reciprocating pump is one containing a drive unit within a crankcase and having a cylinder unit within a manifold connected to the crankcase, in which a reciprocating member reciprocates within the cylinder unit as driven by the drive unit, so as to perform a pumping action such that a liquid in use (working fluid) is aspirated into a pump chamber formed within the cylinder unit on its leading end side and pushed out under pressure (see, for example, Patent Literature 1).

In such a reciprocating pump, a high-pressure seal, a low-pressure seal, and an oil seal are disposed in this order from the pump chamber side to the drive unit side so as to come into slidable contact with the outer peripheral surface of the reciprocating member. The high-pressure seal prevents the liquid in use (high-pressure liquid) within the pump chamber from leaking to the drive unit side through between the cylinder unit and the reciprocating member when a high pressure is generated in the pump chamber, the low-pressure seal backs up the high-pressure seal and further prevents the liquid in use from leaking to the drive unit side, and the oil seal prevents an oil for lubricating components of the drive unit from leaking out from the drive unit side.

CITATION LIST

Patent Literature

Patent Literature 1: Japanese Patent Application Laid-Open No. 2011-17376

SUMMARY OF THE INVENTION

Technical Problem

However, the above-mentioned reciprocating pump incurs a problem that its function as a reciprocating pump may remarkably lower if the liquid in use and the oil mix with each other due to defective sealing and the like. The oil in the drive unit, which is used in a closed environment, progresses its oxidization and deterioration, thereby necessitating periodical replacement. Oil mist brought up by the drive unit may become a problem in clean environments. The liquid in use and the oil must be managed separately from each other, which takes time and effort. It is also problematic in that the load of the drive unit heats the oil, thereby raising temperature.

It is therefore an object of the present invention to provide a reciprocating pump which can overcome the problems mentioned above.

Solution to Problem

The present invention provides a reciprocating pump (100) comprising a reciprocating member (1) adapted to reciprocate as driven by a drive unit (M) contained in a drive unit case (4), so as to perform a pumping action such that a liquid in use is aspirated into a pump chamber (3) formed axially in front of the reciprocating member (1) and pushed out under pressure, the reciprocating pump (100) further comprising a high-pressure seal (18) in slidable contact with an outer peripheral surface of the reciprocating member (1) axially behind the pump chamber (3) so as to prevent the liquid in use from leaking out when a high pressure is generated in the pump chamber (3), wherein a flow path (R) for the liquid in use to flow so as to bathe the drive unit (M) therewith is provided within the drive unit case (4); and wherein the rear side of the high-pressure seal (18) is in contact with the liquid in use flowing through the drive unit case (4).

In thus constructed reciprocating pump (100), the liquid in use is employed for a pumping action in the pump chamber (3) and also flows through the flow path (R) formed within the drive unit case (4), so as to bathe the drive unit (M) therewith, thereby lubricating and cooling the drive unit (M) without using oils. This can overcome the problem of high temperature generated in the drive unit by use of the oil. This can eliminate the low-pressure seal and oil seal for preventing the liquid in use and oil from mixing with each other, thereby cutting cost down. This makes it unnecessary to exchange oils and thus can improve maintainability. Since no oil mist occurs, the environmental load can be lowered. Since it is only necessary to manage the liquid in use, the management cost can be cut down. In addition, the liquid in use flowing through the drive unit case (4) comes into contact with the rear side of the high-pressure seal (18) and thus can fully cool the high-pressure seal (18) even in a structure without the low-pressure seal and oil seal as mentioned above.

Preferably, the reciprocating pump comprises a piston base (1*b*), located behind the high-pressure seal (18), constituting the rear side of the reciprocating member (1); a guide unit (12), adapted to receive the piston base (1*b*), for guiding a reciprocation of the piston base (1*b*); and a communication path (25) for communicating a region (R3), formed in front of the piston base (1*b*), facing the rear side of the high-pressure seal (18) and a flow passage (R4) on the outer periphery side of the guide unit (12) in the flow path (R) with each other. When such a structure is employed, the pumping action by the reciprocation of the piston base (1*b*) with respect to the region (R3) introduces through the communication path (25) the liquid in use flowing through the flow passage (R4) on the outer periphery side of the guide unit (12) in the flow path (R) into the region (R3), formed in front of the piston base (1*b*), facing the rear side of the high-pressure seal (18). Hence, the liquid in use introduced into the region (R3) can fully cool and lubricate the guide unit (12) and lubricate the piston base (1*b*), while being able to fully cool the high-pressure seal (18).

Preferably, the reciprocating pump comprises a piston base (1*b*), located behind the high-pressure seal (18), constituting the rear side of the reciprocating member (1); a guide unit (12), adapted to receive the piston base (1*b*), for guiding a reciprocation of the piston base (1*b*); and a communication hole (26), penetrating through the piston base (1*b*) longitudinally thereof, for communicating a region (R3), formed in front of the piston base (1*b*), facing the rear side of the high-pressure seal (18) and a flow passage (R5) behind the piston base (1*b*) in the flow path (R) with each other. When such a structure is employed, the pumping action by the reciprocation of the piston base (1*b*) with respect to the region (R3) introduces through the communication hole (26) provided in the piston base (1*b*) the liquid in use flowing through the flow passage (R5) behind the piston base (1*b*) in the flow path (R) into the region (R3), formed in front of the piston base (1*b*), facing the rear side of the high-pressure seal (18). Hence, the liquid in use introduced into the region (R3) can fully cool and lubricate the guide unit (12) and lubricate the piston base (1*b*), while being able to fully cool the high-pressure seal (18).

Advantageous Effects of Invention

Thus, the present invention can cut cost down, improve maintainability, lower the environmental load, reduce the management cost, and fully cool the high-pressure seal with the liquid in use even in a structure without the low-pressure seal and oil seal.

DESCRIPTION OF THE PREFERRED EMBODIMENTS

Figure 1:
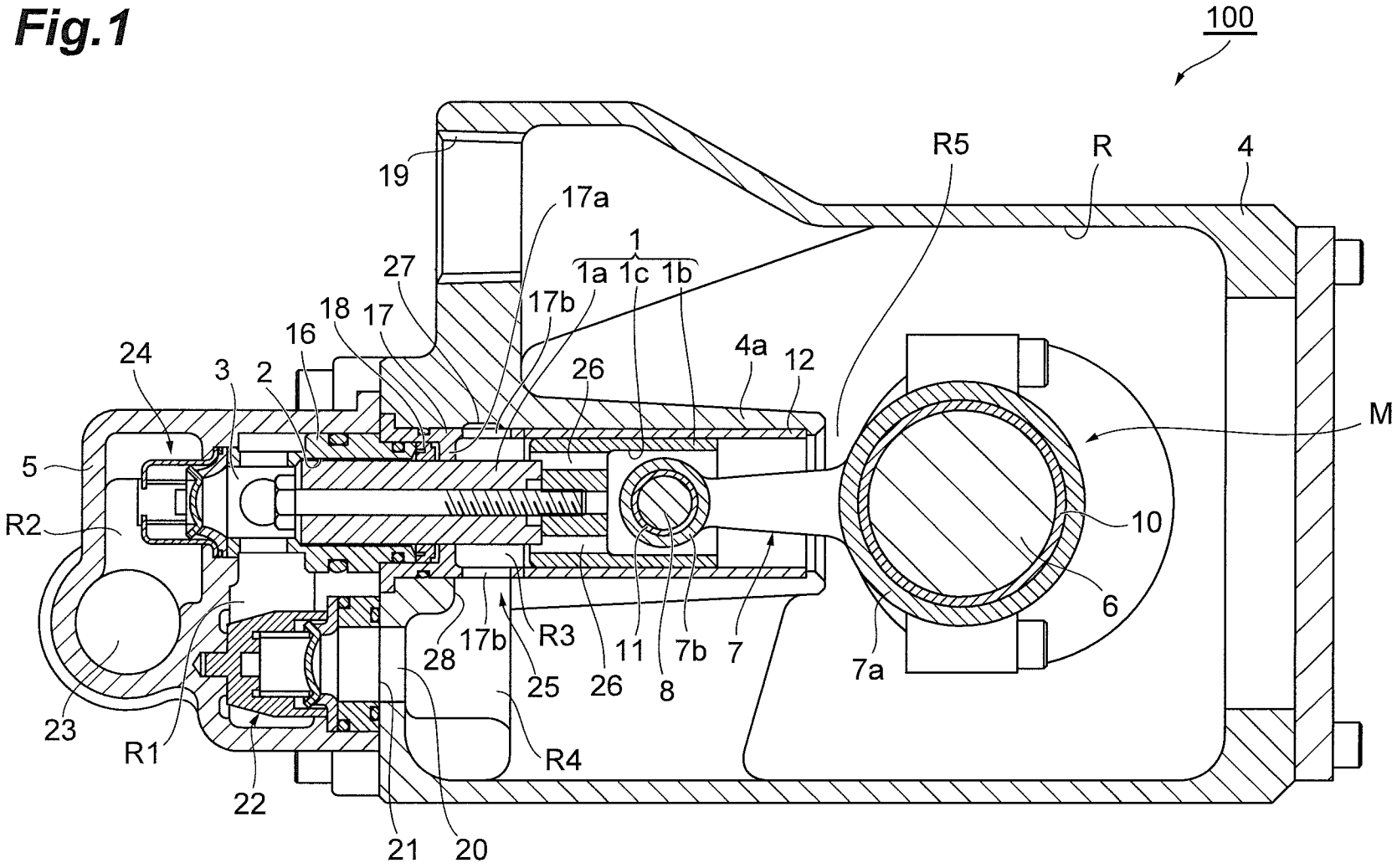
FIG. 1 is a vertical sectional view illustrating the reciprocating pump in accordance with an embodiment of the present invention.
Figure 2:
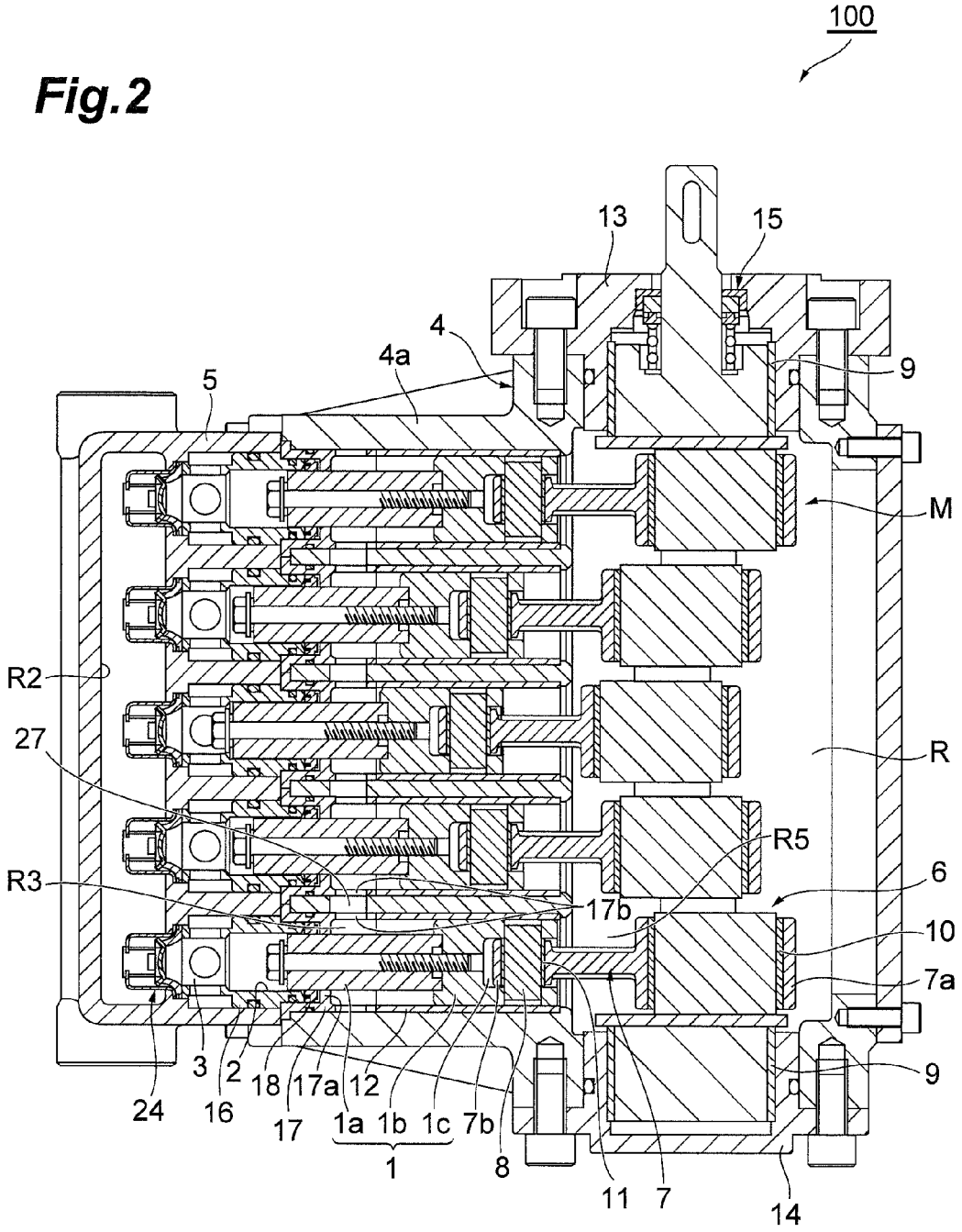
FIG. 2 is a horizontal sectional view of the reciprocating pump illustrated in FIG. 1.
Figure 3:
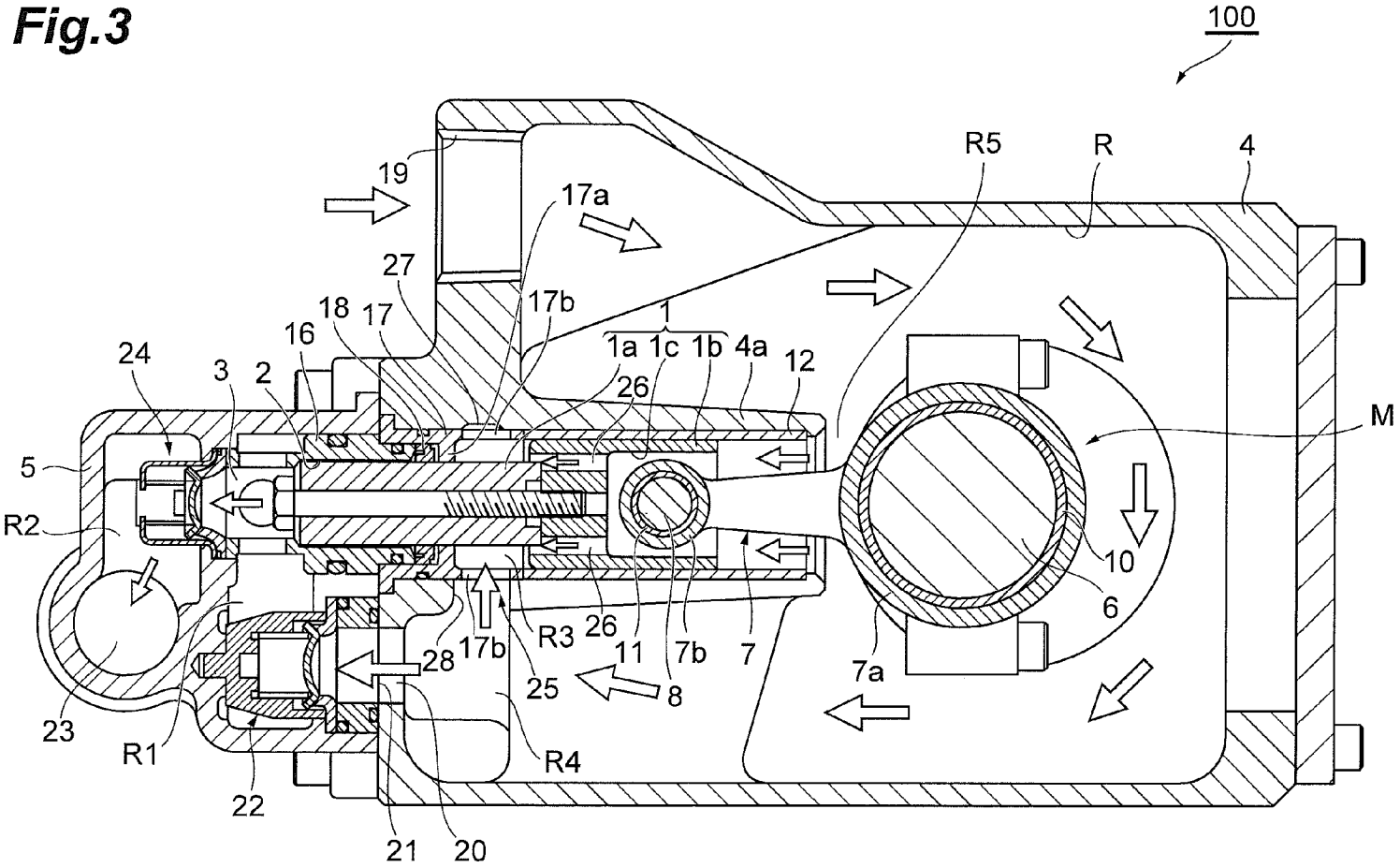
FIG. 3 is a diagram illustrating a flow of a liquid in use in the reciprocating pump depicted in FIG. 1.

In the following, preferred embodiments of the reciprocating pump in accordance with the present invention will be explained with reference to the accompanying drawings. FIG. 1 is a vertical sectional view illustrating the reciprocating pump in accordance with an embodiment of the present invention. FIG. 2 is a horizontal sectional view of the reciprocating pump illustrated in FIG. 1. FIG. 3 is a diagram illustrating a flow of a liquid in use in the reciprocating pump depicted in FIG. 1.

As illustrated in FIGS. 1 and 2, the reciprocating pump 100 in accordance with this embodiment is one in which a reciprocating member 1 reciprocates (moves left and right as depicted) within a cylinder unit 2, so as to perform a pumping action such that a liquid in use is aspirated into a pump chamber 3 formed axially in front of the reciprocating member 1 and pushed out under pressure. The outer form of the reciprocating pump 100 is constructed by connecting a crankcase (drive unit case) 4 and a manifold 5 to each other. The reciprocating pump 100 is a so-called quintuple reciprocating pump in which five sets each comprising the reciprocating member 1 for performing the pumping action and the cylinder unit 2 are arranged in parallel (see FIG. 2).

The reciprocating member 1 has a cylindrical plunger 1*a* and a cylindrical piston base 1*b* connected to one end side of the plunger 1*a*. The plunger 1*a* and the piston base 1*b* are connected to each other with a bolt, so as to reciprocate integrally. In the following, the plunger 1*a* side (left side as depicted) and piston base 1*b* side (right side as depicted) will be referred to as "front side" and "rear side," respectively. The plunger 1*a* is arranged within a cylinder member 16 mounted in the manifold 5 and reciprocates through the inside (cylinder bore) of the cylinder member 16. The piston base 1*b* is connected to a drive unit M through a piston pin 8 (as will be explained later in detail). The inside of the cylinder member 16 constitutes the cylinder unit 2 in which the plunger 1*a* reciprocates. The pump chamber 3 is formed in front of the cylinder unit 2. The piston base 1*b* has a rear end face provided with a forwardly bored depression 1*c* having a diameter larger than that of the plunger 1*a*.

The crankcase 4 is constructed hollow, while its hollow part contains the drive unit M for reciprocating the reciprocating member 1. The hollow part also contains the liquid in use. The liquid in use flows within the hollow part. That is, the hollow part constitutes a flow path R through which the liquid in use flows. The drive unit M is immersed in the liquid in use in the flow path R. That is, the drive unit M is bathed with the liquid in use.

The liquid in use is a liquid serving for the pumping action in the pump chamber 3, for which clear water is used here, though various liquids can be employed.

The drive unit M to be bathed with the liquid in use has a crankshaft 6, a con-rod 7, the piston pin 8, high-strength waterproof resins 9, 10, 11 functioning as bearings, and the like.

The crankshaft 6 is arranged so as to extend in a direction (direction perpendicular to the sheet of FIG. 1 or vertical direction in FIG. 2) orthogonal to the reciprocating direction of the reciprocating member 1. As illustrated in FIG. 2, both end sides of the crankshaft 6 are horizontally supported by bearing cases 13, 14 built in the crankcase 4. An input shaft part of the crankshaft 6 on one end side thereof projects to the outside through the bearing case 13 on the input shaft part side. Thus projected part is supplied with a rotational driving force from a drive source. In the bearing case 13, a tubular mechanical seal 15 is disposed between the part (cylinder bore) for inserting the crankshaft 6 therethrough and the crankshaft 6, so as to seal the crankshaft 6 rotatably.

The high-strength waterproof resins 9 are respectively disposed between the crankshaft 6 and the bearing cases 13, 14 and support the crankshaft 6 rotatably. Various resins can be employed as the high-strength waterproof resins 9 and high-strength waterproof resins 10 to 12 which will be explained later. Particularly preferred examples of the resins include PEEK (polyether ether ketone) resins.

As illustrated in FIGS. 1 and 2, the con-rod 7 is provided for each reciprocating member 1 and has a large-diameter part 7*a* on the crankshaft 6 side and a small-diameter part 7*b* on the reciprocating member 1 side. The large-diameter part 7*a* is rotatably supported by the crankshaft 6 through the high-strength waterproof resin 10. The smaller-diameter part 7*b* is rotatably attached to the piston pin 8 through the high-strength waterproof resin 11.

The inside of the crankcase 4 on the front side (cylinder unit 2 side) projects rearward so as to approach the crankshaft 6 (see FIG. 1), while a tubular guide unit 12 is contained in and secured to thus projected part 4*a*. The guide unit 12 is formed from the high-strength waterproof resin mentioned above, receives the piston base 1*b* in its cylinder bore, and guides reciprocations of the piston base 1*b*. The small-diameter part 7*b* on the reciprocating member 1 side of the con-rod 7 enters the depression 1*c* of the piston base 1*b* located within the guide unit 12, so that both ends of the piston pin 8 are secured as being press-fitted to the piston base 1*b*.

In front of the guide unit 12 in the crankcase 4, a tubular seal case 17 is disposed so as to abut to the guide unit 12. The seal case 17 is provided with an inwardly projecting annular flange 17*a* in its axially middle part. The plunger 1*a* of the reciprocating member 1 penetrates through the inside of the flange 17*a*, while a high-pressure seal 18 abuts to the front surface of the flange 17*a* and is securely contained in the seal case 17.

The high-pressure seal 18 is used for preventing the liquid in use within the pump chamber 3 from leaking rearward through a gap with the plunger 1*a* when a high pressure is generated in the pump chamber 3. The high-pressure seal 18 is constructed tubular and arranged axially behind the pump chamber 3, so as to come into slidable contact with the outer peripheral surface of the plunger 1*a*. The inner surface of the cylinder member 16 including the high-pressure seal 18 is referred to as the cylinder unit 2.

Attaching the manifold 5 with respect to the crankcase 4 with bolts or the like, for example, positions and secures the guide unit 12, seal case 17, high-pressure seal 18, and cylinder member 16 axially (in the depicted horizontal direction) in a state held between the insides of the crankcase 4 and manifold 5.

As illustrated in FIG. 1, the upper part of the crankcase 4 bulges higher than the manifold 5, while thus upwardly bulged end face on the manifold 5 side (front end face) is formed with a water inlet 19 which communicates with the flow path R within the crankcase 4 in order for the liquid in use to flow into the flow path R. At a position below each of the seal cases 17, the end face on the manifold 5 side of the crankcase 4 is formed with a flow outlet 20 which communicates with the flow path R within the crankcase 4 in order for the liquid in use to flow from the flow path R to the manifold 5 side. Hence, a flow of the liquid in use is formed within the crankcase 4 through the flow path R from the water inlet 19 to the flow outlet 20.

The manifold 5 is formed with a flow inlet 21 which communicates with the flow outlet 20 of the crankcase 4, while an intake flow path R1 through which the liquid in use flows from the flow path R within the crankcase 4 is formed between the flow inlet 21 and the pump chamber 3. The intake flow path R1 is provided with an intake valve 22 for opening and closing the same.

The manifold 5 is provided with an outlet 23 for letting out the liquid in use from the pump chambers 3, while a leading end of each pump chamber 3 is provided with an outlet valve 24 as illustrated in FIGS. 1 and 2 so as to constitute the pump chamber 3. Each outlet valve 24 opens and closes, so as to open and close its corresponding pump chamber 3, while an outlet flow path R2 through which the liquid in use flows from the pump chamber 3 is formed between the outlet side of each outlet valve 24 and the outlet 23.

In the crankcase 4 of thus constructed reciprocating pump 100, an annular region R3 for the liquid in use to flow in is formed in front of the piston base 1*b* while facing the rear side (rear end face) of the high-pressure seal 18. A communication path 25 and communication holes 26 are provided in order for the liquid in use within the crankcase 4 to flow into the region R3.

The communication path 25 comprises openings 17*b* which are respectively formed at upper, lower, left, and right parts of the seal case 17, an annular flow path 27 which is located on the outer periphery side of the seal case 17 and communicates with the openings 17*b*, and a communication path 28 which communicates the annular flow path 27 with a flow path R4 below the projected part 4*a* of the crankcase 4 and the seal case 17, so that the liquid in use in the flow path R4 can be introduced into the region R3 through the communication path 28, annular flow path 27, and openings 17*b*.

The communication holes 26 are a plurality of through holes penetrating through the piston base 1*b* longitudinally thereof, so that the liquid in use in the flow path behind the piston base 1*b*, more specifically the liquid in use in a flow path R5 between the projected part 4*a* of the crankcase 4 and the crankshaft 6, can be introduced into the region R3 through the communication holes 26.

In thus constructed reciprocating pump 100, the drive unit M is driven in a state where the liquid in use is introduced from the water inlet 19 into the flow path R within the crankcase 4 so as to bathe the drive unit M therewith. Then, the crankshaft 6 rotates, and this rotational motion is converted into a reciprocating motion through the con-rod 7 and piston pin 8, whereby the reciprocating member 1 reciprocates. The plunger 1*a* moves through the cylinder unit 2 toward the crankshaft 6, so as to reduce the pressure in the pump chamber 3, thereby opening and closing the intake valve 22 and outlet valve 24 of the manifold 5, respectively. The liquid in use is aspirated from the flow path R in the crankcase 4 through the intake flow path R1 and intake valve 22 of the manifold 5 into the pump chamber 3. On the other hand, the plunger 1*a* moves through the cylinder unit 2 toward the pump chamber 3, so as to pressurize the latter, thereby closing and opening the intake valve 22 and outlet valve 24, respectively. The liquid in use in the pump chamber 3 flows through the outlet valve 24 and outlet flow path R2, so as to be let out from the outlet 23. Such a pumping action for aspirating and discharging the liquid in use is performed repeatedly.

When the pressure in the pump chamber 3 is reduced under such a pumping action, the liquid in use forms a flow which is introduced from the water inlet 19, mainly directed rearward along the upper face of the projected part 4*a*, turned to the rear side from the upper side of the crankshaft 6 so as to be directed to the lower side thereof, and then directed to the flow outlet 20 through the flow path R4 as indicated by arrows in FIG. 3. A part of the liquid in use introduced from the water inlet 19 also forms a flow which is directed downward through the flow path R5 between the projected part 4*a* of the crankcase 4 and the crankshaft 6, so as to run into the flow path R4.

Hence, the high-strength waterproof resins 9, 10 functioning as bearings are fed with the liquid in use, so as to be fully cooled and lubricated. As a consequence, their functions as bearings can be exhibited fully.

As the reciprocating member 1 reciprocates, the piston base 1*b* reciprocates through the guide unit 12, so as to perform a pumping action, by which the liquid in use in the flow path R4 in the crankcase 4 is introduced through the communication path 25, specifically through the communication path 28, annular flow path 27, and openings 17*b*, into the annular region R3 formed in front of the piston 1*b* while facing the rear side of the high-pressure seal 18 as indicated by arrows in FIG. 3.

Under the pumping action of the piston base 1*b*, the liquid in use flowing through the flow path R5 within the crankcase 4 is introduced into the region R3 through the depression 1*c* and communication holes 26 of the piston base 1*b* as indicated by arrows in FIG. 3.

Thus, the liquid in use flowing through the crankcase 4 is introduced into the region R3 from both of the communication path 25 and communication holes 26. The liquid in use introduced into the region R3 fully cools and lubricates the guide unit 12 and fully lubricates the piston base 1*b*, while fully cooling the rear face of the high-pressure seal 18. The liquid in use flowing from the flow path R5 into the guide unit 12 (the liquid in use from the rear side with respect to the inside of the guide unit 12) also performs such cooling and lubricating of the guide unit 12 and lubricating of the piston base 1*b*.

Under the pumping action by the reciprocation of the piston base 1*b*, the liquid in use introduced into the region R3 through the communication path 25 and communication holes 26 is pushed out to the flow paths R4, R5 through the communication path 25 and communication hole 26, respectively, in directions opposite to those at the time of introduction, and such input and output are repeated, so that a fresh liquid in use is always contained in the region R3.

The liquid in use flowing forward through the depression 1*c* of the piston base 1*b* fully cools and lubricates the high-strength waterproof resin 11 within the depression 1*c*, so that its function as a bearing is fully exhibited.

Thus, this embodiment is constructed such that the liquid in use is employed for a pumping action in the pump chamber 3 and also flows through the flow path R within the crankcase 4 so as to bathe the drive unit M therewith, thereby lubricating and cooling the drive unit M without oils. This can overcome the problem of high temperature generated in the drive unit by use of the oil. This can eliminate the low-pressure seal and oil seal for preventing the liquid in use and oil from mixing with each other, thereby cutting cost down. This makes it unnecessary to exchange oils and thus can improve maintainability. Since no oil mist occurs, the environmental load can be lowered. Since it is only necessary to manage the liquid in use, the management cost can be cut down. In addition, the liquid in use flowing through the crankcase 4 comes into contact with the rear side of the high-pressure seal 18 and thus can fully cool the high-pressure seal 18 even in a structure without the low-pressure seal and oil seal.

Since the pumping action by the reciprocation of the piston base 1*b* introduces through the communication path 25 the liquid in use flowing through the flow passage R4 on the outer periphery side of the guide unit 12 into the region R3, the liquid in use introduced into the region R3 fully lubricates the piston base 1*b*, while fully cooling the high-pressure seal 18. The guide unit 12 is also fully cooled and lubricated, so as to fully exhibit its function as a bearing.

Since the pumping action by the reciprocation of the piston base 1*b* introduces through the communication holes 26 of the piston base 1*b* the liquid in use flowing through the flow path R5 behind the piston base 1*b* into the region R3, the liquid in use introduced into the region R3 fully lubricates the piston base 1*b*, while fully cooling the high-pressure seal 18. The guide unit 12 is also fully cooled and lubricated, so as to fully exhibit its function as a bearing.

Since the water inlet 19 and flow outlet 20 are arranged at positions substantially vertically symmetrical to each other across the projected part 4*a* of the crankcase 4 interposed therebetween, the flow of the liquid in use within the crankcase 4 can be provided with such a directivity as that of the flow path R, so as to further enhance the lubricating effect.

The present invention is specifically explained in the foregoing according to its embodiment, but is not limited thereto. For example, while the liquid in use flowing through the crankcase 4 is introduced into the region R3 from both of the communication path 25 and communication hole 26 in the above-mentioned embodiment, one of the communication path 25 and communication hole 26 may be provided alone, so that the liquid is introduced therefrom.

What is claimed is:

1. A reciprocating pump comprising:

a reciprocating member configured to reciprocate so as to perform a pumping action such that a liquid in use is aspirated into a pump chamber formed axially in front of the reciprocating member and pushed out under pressure;

a driver configured to drive the reciprocating member so as to perform the pumping action;

a high-pressure seal in slidable contact with an outer peripheral surface of the reciprocating member axially behind the pump chamber so as to prevent the liquid in use from leaking out when a high pressure is generated in the pump chamber; and a piston base, located behind the high-pressure seal, constituting a rear side of the reciprocating member, wherein a flow path for the liquid in use to flow so as to bathe the driver therewith is provided within the driver case, wherein the piston base is configured to reciprocate so as to introduce the liquid in use in the flow path into an annular region facing a rear side of the high-pressure seal and to push out the liquid in use in the annular region to the flow path, then the rear side of the high-pressure seal is in contact with the liquid in use introduced into the annular region.

2. The reciprocating pump according to claim 1, further comprising:

a tubular guide unit, adapted to receive the piston base, that guides a reciprocation of the piston base; and a communication path for communicating the annular region and a flow passage on the outer periphery side of the tubular guide unit in the flow path with each other.

3. The reciprocating pump according to claim 1, further comprising:

a tubular guide unit, adapted to receive the piston base, that guides a reciprocation of the piston base; and a communication hole, penetrating through the piston base longitudinally thereof, communicating the annular region and a flow passage behind the piston base in the flow path with each other.

4. A reciprocating pump for reciprocating a reciprocating member so as to aspirate a liquid in use and push out the liquid in use under pressure, the reciprocating pump comprising:

the reciprocating member;

a pump chamber for receiving the liquid in use;

a driver, connected to a one end of the reciprocating member, driving the reciprocating member;

a plunger, disposed at an other end of the reciprocating member, that reciprocates so as to aspirate the liquid in use into the pump chamber and pushing the liquid in use out of the pump chamber under pressure;

a driver case for containing the driver;

a high-pressure seal, in slidable contact with an outer peripheral surface of the reciprocating member, for preventing the liquid in use from leaking from the pump chamber to the one end side of the reciprocating member;

a flow path of the liquid in use provided within the driver case so as to bathe the driver with the liquid in use; and a piston base, located closer to the one end of the reciprocating member than is the high-pressure seal, constituting a part of the reciprocating member, wherein the piston base is configured to reciprocate so as to introduce the liquid in use in the flow path into an annular region facing the high-pressure seal and to push out the liquid in use in the annular region to the flow path, then the high-pressure seal is in contact with the liquid in use introduced into the annular region.

5. The reciprocating pump according to claim 4, further comprising:

a tubular guide unit, surrounding the piston base within the flow path, that guides the reciprocation of the piston base; and a communication path communicating the annular region and the flow path with each other.

6. The reciprocating pump according to claim 4, further comprising:

a tubular guide unit, surrounding the piston base within the flow path, that guides the reciprocation of the piston base; and a communication hole penetrating through the piston base along a reciprocating direction of the reciprocating member.

7. A reciprocating pump for reciprocating a reciprocating member so as to aspirate a liquid in use and push out the liquid in use under pressure, the reciprocating pump comprising:

the reciprocating member;

a pump chamber for receiving the liquid in use;

a crankshaft and a con-rod, connected to a one end of the reciprocating member, driving the reciprocating member;

a plunger, disposed at an other end of the reciprocating member, that reciprocates so as to aspirate the liquid in use into the pump chamber and pushing the liquid in use out of the pump chamber under pressure;

a driver case for containing the crankshaft and the con-rod;

a high-pressure seal, in slidable contact with an outer peripheral surface of the reciprocating member, that prevents the liquid in use from leaking from the pump chamber to the one end side of the reciprocating member;

a flow path of the liquid in use provided within the driver case so as to bathe the crankshaft and the con-rod with the liquid in use; and a piston base, located closer to the one end of the reciprocating member than is the high-pressure seal, constituting a part of the reciprocating member, wherein the piston base is configured to reciprocate so as to introduce the liquid in use in the flow path into an annular region facing the high-pressure seal and to push out the liquid in use in the annular region to the flow path, then the high-pressure seal is in contact with the liquid in use introduced into the annular region.

8. The reciprocating pump according to claim 7, further comprising:

a tubular guide unit, surrounding the piston base within the flow path, that guides the reciprocation of the piston base; and a communication path communicating the annular region and the flow path with each other.

9. The reciprocating pump according to claim 7, further comprising:

a tubular guide unit, surrounding the piston base within the flow path, that guides the reciprocation of the piston base; and a communication hole penetrating through the piston base along a reciprocating direction of the reciprocating member.

* * * * *